United States Patent [19]

Miyamoto

[11] 4,023,512

[45] May 17, 1977

[54] THREAD FEEDER FOR SEWING MACHINE

[76] Inventor: Toshio Miyamoto, 17-27, 2-chome, Himezato, Nishiyodogawa, Osaka, Japan

[22] Filed: Sept. 13, 1975

[21] Appl. No.: 610,057

[30] Foreign Application Priority Data

Sept. 3, 1974 Japan ..... 49-102191

[52] U.S. Cl. ..... 112/242; 112/225; 112/254

[51] Int. Cl.[2] ..... D05B 49/00

[58] Field of Search ..... 112/254, 79 R, 79 A, 112/218 R, 242, DIG. 1, DIG. 2, DIG. 3

[56] References Cited

UNITED STATES PATENTS

| | | | |
|---|---|---|---|
| 3,067,704 | 12/1962 | Pedersen | 112/254 |
| 3,364,889 | 1/1968 | Weiner | 112/218 R |
| 3,508,690 | 4/1970 | Pozzolo | 112/225 X |
| 3,721,205 | 3/1973 | Ono et al. | 112/254 |

*Primary Examiner*—H. Hampton Hunter
*Attorney, Agent, or Firm*—George B. Oujevolk

[57] ABSTRACT

A thread feeder for sewing machines is disclosed which feeds the thread from one of the bobbins to an automatic threading machine. It includes a movable table over the sewing machine, bobbins mounted thereon, thread tension regulators for adjusting tension to the thread from the bobbin, and feed rollers for feeding the thread from the thread tension regulator to the automatic threading device on a sewing machine. By such an arrangement, threads of different color or material can be fed conveniently one after another in a desired order.

2 Claims, 5 Drawing Figures

THREAD FEEDER FOR SEWING MACHINE

The present invention relates to a thread feeder for sewing machines, particularly for ones which use a plurality of threads of different kind or color to produce a desired pattern, such as sewing machines for embroidery.

It is an object of the present invention to provide a thread feeder which can feed the thread from a plurality of bobbins mounted on a movable table in a desired order to an automatic threading device on a sewing machine.

It is another object of the present invention to provide a thread feeder of the aforesaid type which permits free change of the thread fed to the needle on the sewing machine when combined with an automatic threading device. Other objects and advantages of the present invention will become apparent from the following description with reference to the accompanying drawings in which.

Figure 1:
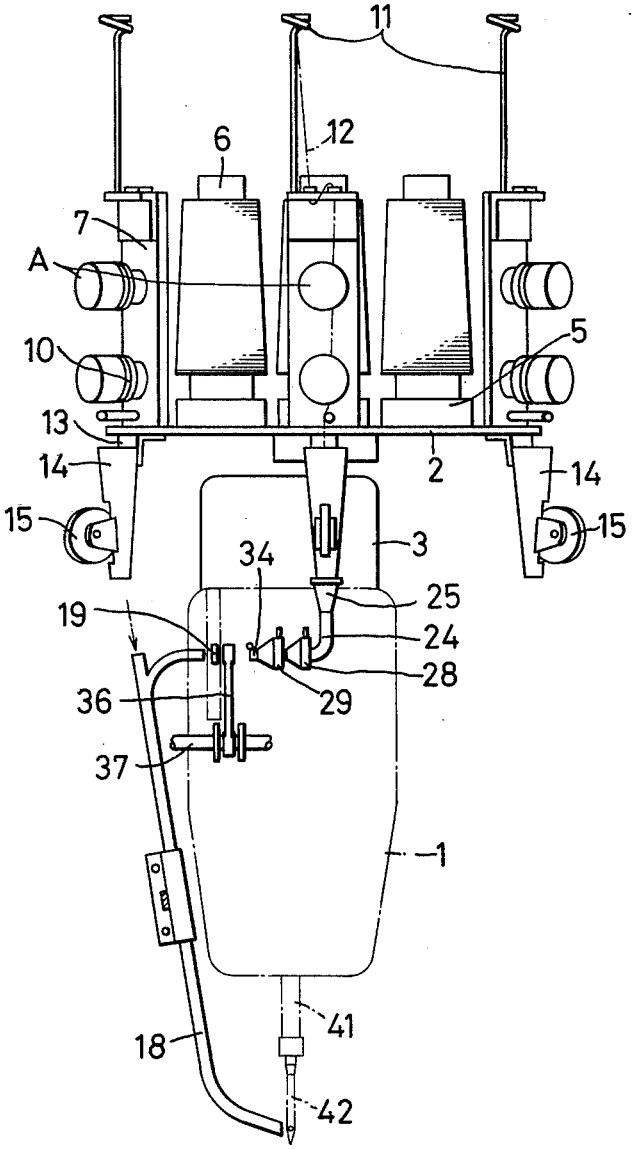
FIG. 1 is a front view of a thread feeder embodying the present invention, showing it combined with an automatic threading device.
Figure 5:
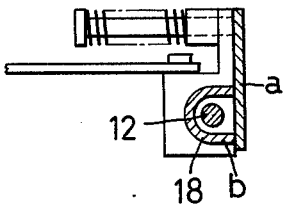
FIG. 5 is an enlarged cross-sectional view of the thread guide pipe thereof.

Referring to FIGS. 1 to 5, the numeral 1 designates the arm of a sewing machine. A circular or polygonal movable table 2 is mounted over the arm 1 to be turned intermittently through a shaft 4 by means of driving means 3 mounted on the arm 1. The movable table 2 may be adapted to be movable in a longitudinal or transverse direction. The movable table 2 has a plurality of bobbin holders 5 arranged thereon circumferentially at a regular angular distance. A bobbin 6 is mounted on each bobbin holder 5. At outside of each bobbin holder 5 is secured a frame 7 to the outer periphery of the movable table 2.

At top of each frame 7 is provided a thread guide 11 through which the thread 12 from the bobbin 6 is led to a thread tension regulator A provided at top outside of the frame 7. This regulator A is an ordinary thread tension regulator for sewing machines which has two spring-loaded tension discs 8 for giving tension to the thread passed therebetween. By turning a dial 9, the bias of the spring and thus the tension to the thread can be adjusted. When pressed, a pin 47 projecting from the rear of each regulator A relaxes the spring for the tension discs, thus removing tension to the thread. A roller 10 below the regulator A is a mere grooved guide roller though it is of a similar shape.

Just under each guide roller 10 is secured a tapered guide tube 14 to the movable table 2 through a bracket 13, said guide tube being open at both ends and being of a smaller diameter at its lower end. A feed roller 15 of such material as rubber is rotatably pivoted to the outside of each guide tube 14 so as for a portion thereof to project thereinto through a vertical slit formed therein.

The letter B designates driving means to which is connected a pivotable lever 16 actuated by an electromagnet or an air cylinder and carrying a driving roller 17 at its tip. The driving roller 17 is driven in the direction of arrow (FIG. 2) through belt or gear from a motor in the driving means B. When the lever 16 is in its lower position, the driving roller 17 projects into the guide tube 14 through another vertical slit formed therein to cooperate with the feed roller 15 to feed down the thread 12 held therebetween.

The parts constituting an automatic threading device will be described below.

The numeral 18 designates a thread guide pipe secured to the end of the arm 1. The thread guide pipe 18 is curved adjacent to its top end toward the thread take-up 19 of the sewing machine so that its inlet 21 is opposed to the thread hole 20 in the latter. At the curve of the guide pipe 18 is provided a blast port 22 through which air is blown in to suck the thread 12 thereinto and feed it to the outlet 23 at its bottom.

A suction pipe 24 curved into L shape is secured to the end of the arm 1 at such a position that a tapered portion 25 at its top is directly under the guide tube 14 in its thread-feeding position. Intermediately of the suction pipe 14 are formed two spaces 26 and 27 at the outer periphery of which are provided a blast box 28 and a suction box 29, respectively, to which are connected a blast line 30 and a suction line 31, respectively. The blast box 28 communicates with the space 26 through an annular tapered passage 32, and the suction box 29 similarly does with the space 27 through another annular tapered passage 33. A check valve 35 is provided at the outlet 34 of the suction pipe 24 to prevent air stream from flowing back into the pipe 24.

A lever 36 is pivoted to the arm 1 through an axis 37. When it is pivoted up, a thread hole 38 in its tip comes between the outlet 34 of the suction pipe 24 and the hole 20 in the thread take-up 19 in alignment therewith.

A rod 39 is slidable along a guide suitably mounted on the arm 1 and has a hard wire 45 fixed at its tip and formed with a hook 40 turned up to catch the thread.

A needle 42 having a hole 42 formed therein is attached to the lower end of a needle holder 41. The arm 1 is also provided with an automatic thread cutter 44 of a scissors type, for example, for cutting the thread 12 directly over the tapered portion 25 when actuated by an electromagnet.

The thread guide pipe 18 may be unsplittable though in this preferred embodiment it consists of a base plate *a* secured to the arm 1 and a cover member *b* of U-shape section mounted thereon to close the pipe and is splittable by pulling the latter through a lever by means of driving means 46, such as an electromagnet, mounted on the arm 1.

The operation of a preferred embodiment will now be described. With the hole 20 in the thread take-up 19, the hole 38 in the lever 36, the outlet 34 of the suction pipe 24 and the inlet 21 of the thread guide pipe 18 in alignment with one another, the driving means B operates to pivot down the lever 16 to put the driving roller 17 into its operative position. The thread 12 pending from the guide roller 10 is caught between the rollers 15 and 17 and is fed down as the roller 17 is being rotated in the direction of arrow.

When the thread 12 reaches the tapered portion 25, a solenoid valve in the suction line 31 has connected to a vacuum pump (not shown) has already opened so that it is sucked into the suction pipe 24. The thread 12 moves through the suction pipe 24 toward its outlet 34 by the feeding action of the rollers 15 and 17 and suction by the suction pipe 24. When it arrives at the space 27, a solenoid valve in the blast line 30 connected to an air pump (not shown) opens to allow compressed air to blow through the passage 32 and the space 26 toward the outlet 34. Then the solenoid valve in the suction 31 closes. Thus the thread 12 finds its way toward the outlet 34 with the stream of air. Forced open by the air stream, the check valve 35 allows the thread 12 to pass through the outlet 34. It then passes through the holes in the lever 36 and in the thread take-up 19 toward the inlet 21 of the thread guide pipe 18.

Because compressed air blown into the pipe 18 from the blast port 22 sets its inlet 21 under negative pressure, the thread 12 is sucked thereinto, making its way downward therethrough toward the outlet 23.

While air stream carries the thread 12, the rollers 15 and 17 keep rotating to feed it down. The feeding speed is preferably adjusted to be slightly lower than the speed at which it is carried by air, to prevent it from loosening.

On the sewing machine embodying the present invention, if it automatically stops upon thread breakage, for example, the needle 42 comes up through the cloth into position. Simultaneously, the driving means for the rod 39 also operates to advance it until the hook 40 passes through the needle hole 43 and stops slightly beyond the thread outlet 23. After the tip of the thread 12 has come out of the outlet 23 and gotten on the hard wire 45, the rod 39 retracts through the needle hole 43 catching the thread by the hook 40. It has now been passed through the needle hole 43.

Figure 2:
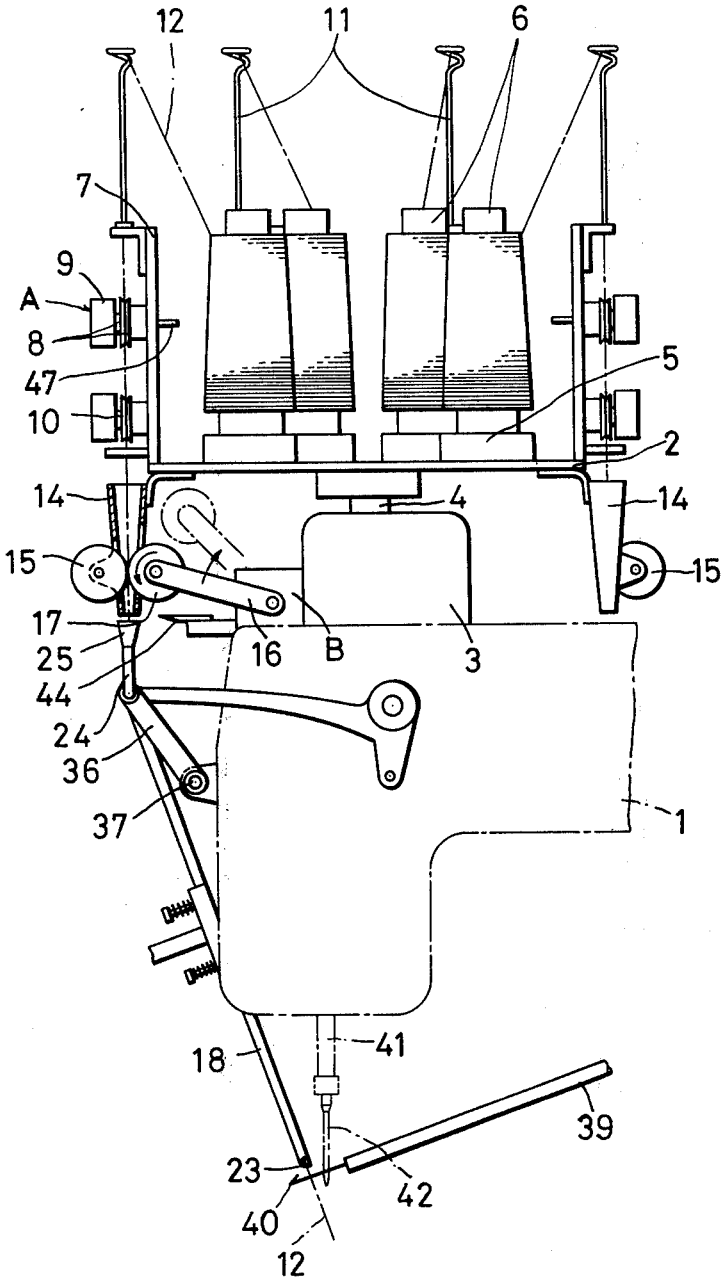
FIG. 2 is a partially cutaway side view thereof.
Figure 3:
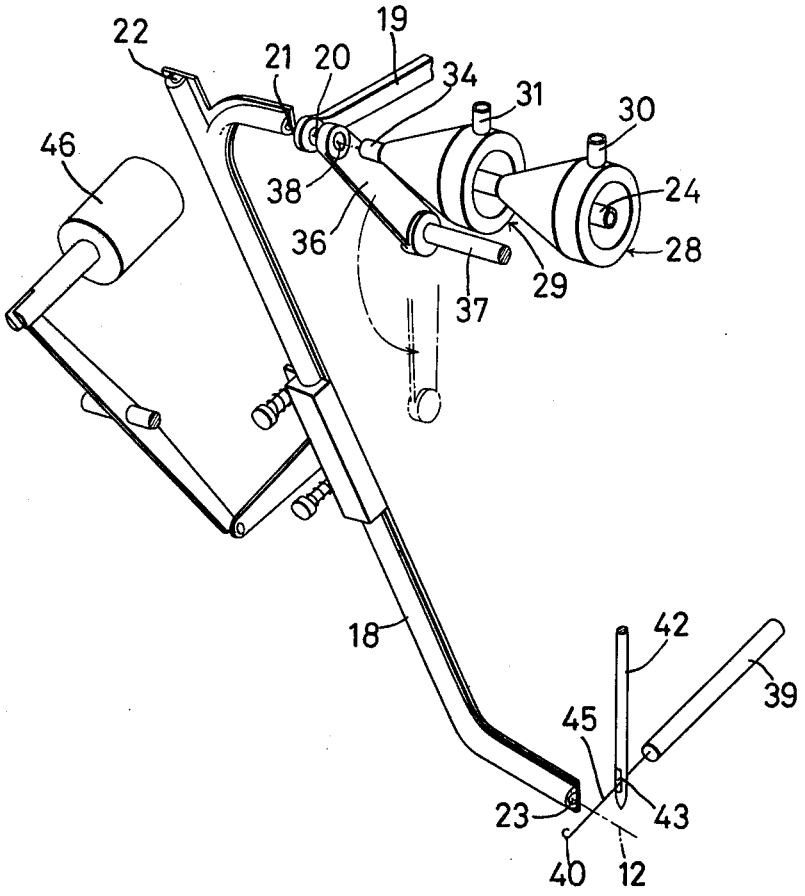
FIG. 3 is a perspective view of the automatic threading device to be combined with the thread feeder of the present invention.
Figure 4:
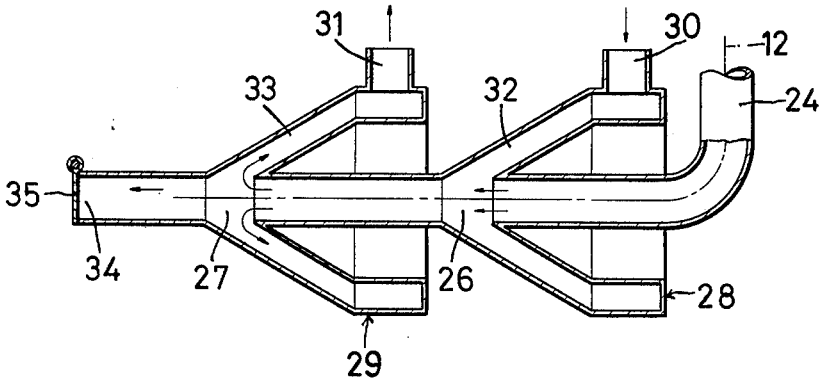
FIG. 4 is an enlarged vertical cross-sectional view of the thread suction pipe of the automatic threading device of FIG. 3.

The lever 16 is then pivoted up (as shown in FIG. 2 by an alternate long and short dash line) to get the roller 17 off the roller 15. Simultaneously, the driving means 46 also operates to pull the cover member *b* off the base plate *a*, thereby releasing the thread from the thread guide pipe 18. And the sewing machine is put into operation.

During the feeding of thread by the rollers 15 and 17, the pin 47 for the tension discs 8 may be pressed by a lever actuated as by an electromagnet to remove tension to the thread to facilitate the feeding-out of the thread.

After sewing with the thread 12 thus passed through the needle 42 is complete, the sewing machine is stopped in response to a signal from a suitable control system. At the same time, the automatic thread cutter 44 operates to cut the thread 12.

The driving means 3 then operate to turn the movable table 2 until the guide tube 14 serving for a desired bobbin 6 comes just over the tapered portion 25. Threading is repeated for the thread from that bobbin in the same manner as described above, and so on.

In this invention, a movable table carrying a plurality of bobbins is moved in response to a signal from a suitable control system to such a position that a desired bobbin comes over the automatic threading device of the sewing machine, to feed the thread from the bobbin to the suction port of the automatic threading device.

It will be understood from the foregoing description that the present invention provides a thread feeder suitable for use on a sewing machine, particularly for embroidery, on which a plurality of threads of different color or kind are used in a predetermined order to sew out a desired pattern.

Although in the preferred embodiment the movable table is turnable, it may be adapted to be movable in a longitudinal or transverse direction. The thread feeder of the present invention may also be combined with an automatic threading device of any other type than the one herein described.

What is claimed is:

1. A thread feeder for a sewing machine to selectively feed a thread from one of several bobbins to the eye (43) of a sewing machine needle (42) in a needle holder (41) at the working end of an arm (1), comprising in combination:

a. a moveable table (2) disposed above said arm (1) having a plurality of bobbin holders (5) for supporting bobbins with thread (12) thereon for moving said bobbins to a feeding station;

b. guide means (14, 15) below each bobbin to guide and feed thread from the bobbin downwards;

c. a suction-pipe (24) at said feeding station with an outwardly flanged downwardly tapered portion at its top so adapted and disposed that the guide means (14) can be disposed directly over said flanged portion, blast and suction means (28, 29) coupled to said suction pipe (24); and, d. a thread take-up (19) fed by said suction pipe (24) with an outlet thread aperture (20) and an elongated thread guide pipe (18) having an inlet (21) opposite said thread aperture (20), and an outlet (23) opposite said eye (43), a blast port (22) in said thread guide pipe (18) into which air is blown to suction the thread through the thread guide pipe (18) to said outlet (23).

2. A thread feeder as claimed in claim 1 including pivotable lever means (36) having an aperture (38) adjacent said thread take-up (19), the pivoted position of the lever providing tension to the thread.

* * * * *